US006235697B1

(12) United States Patent
Knorr et al.

(10) Patent No.: US 6,235,697 B1
(45) Date of Patent: May 22, 2001

(54) LAUNDRY DETERGENT COMPOSITION CONTAINING LEVEL PROTEASE ENZYME

(75) Inventors: Joseph Robert Knorr, Edison; Barbara Hepler, South Bound Brook; Mary Holmgren, Somerville, all of NJ (US)

(73) Assignee: Colgate-Palmolive Co., New York, NY (US)

( * ) Notice: Subject to any disclaimer, the term of this patent is extended or adjusted under 35 U.S.C. 154(b) by 0 days.

(21) Appl. No.: 09/569,665

(22) Filed: May 12, 2000

Related U.S. Application Data

(63) Continuation-in-part of application No. 09/314,838, filed on May 19, 1999, now abandoned.

(51) Int. Cl.[7] ..... C11D 3/386; C11D 3/395; C11D 3/31

(52) U.S. Cl. ..... 510/300; 510/305; 510/306; 510/309; 510/372; 510/376; 510/477; 510/530; 8/137

(58) Field of Search ..... 510/300, 305, 510/306, 309, 372, 376, 392, 530, 477; 8/137

(56) References Cited

U.S. PATENT DOCUMENTS

H1513 * 1/1996 Murch et al. ..... 252/546
5,707,950 * 1/1998 Kasturi et al. ..... 510/320
5,783,546 * 7/1998 Bettiol et al. ..... 510/305
5,798,327 * 8/1998 Casteleijn et al. ..... 510/303
5,858,948 * 7/2000 Ghosh et al. ..... 510/300
5,925,609 * 7/1999 Baillely et al. ..... 510/306
5,929,018 * 7/1999 Baillely et al. ..... 510/392
6,008,178 * 11/1999 Baillely et al. ..... 510/392
6,087,314 * 7/2000 Heinzman et al. ..... 510/532
6,103,685 * 8/2000 Hall ..... 510/475

FOREIGN PATENT DOCUMENTS

0713910 * 10/1995 (EP) .

* cited by examiner

*Primary Examiner*—Kery Fries
(74) *Attorney, Agent, or Firm*—Bernard Lieberman

(57) ABSTRACT

A laundry detergent composition is provided for enhanced whitening and stain removal of washed laundry comprising:

a) from about 1% to about 50%, by weight, of a surfactant or surfactant mixture selected from the group consisting of anionic and nonionic surfactants;

b) a protease enzyme in an amount sufficient to provide from at least about 0.030 to about 3.0 Kilo Novo Protease Units (KNPU) of activity of protease enzyme per gram of detergent composition;

c) a cellulase enzyme of the endoglucanase type in an amount sufficient to provide from about 0.5 to about 100 CMC units per gram of detergent composition; and d) from about 0.5% to about 10% by weight, of an acrylic acid-based polymer and copolymer.

10 Claims, No Drawings

LAUNDRY DETERGENT COMPOSITION CONTAINING LEVEL PROTEASE ENZYME

This application is a continuation-in-part application of U.S. Ser. No. 09/314,838, filed May 19, 1999, now abandoned, the disclosure of which is herein incorporated by reference.

This invention relates to laundry detergent compositions having enhanced whitening and stain removal benefits. More particularly, this invention relates to laundry detergent compositions containing among other components, a combination of an endo-cellulase enzyme, a protease enzyme and polyacrylate polymer, and which is particularly effective for providing enhanced whitening and stain removal benefits to soiled fabrics.

BACKGROUND OF THE INVENTION

Cellulase enzymes and protease enzymes are known components of laundry detergent compositions which chemically decompose stains and provide improved cleaning of washed fabrics. For example, U.S. Pat. No. 5,858,948 describes laundry detergent compositions wherein the combination of a protease enzyme with a modified polyamine cotton soil release agent provides improved cleaning and soil release benefits.

In U.S. Pat. No. 5,707,950 the inclusion of lipase enzyme in combination with a proteolytic enzyme and a surfactant is said to provide dingy soil clean-up and whiteness maintenance benefits. The protease enzymes are described as providing from 0.005 to 0.1 Anson units of activity per gram of composition.

In U.S. Statutory Invention Registration H1513 there is described a detergent composition containing a defined fatty acid amide surfactant in combination with oleoyl sarcosinate to provide improved soil and stain removal from fabrics. Enzymes selected from among protease, cellulase and lipase enzymes are optional additives to the detergent composition to remove protein-based, carbohydrate-based or triglyceride-based stains, as well as for preventing dye transfer, and for fabric restoration.

Endo-type alkaline cellulases are a known class of cellulase enzyme which may be included as an ingredient in detergent compositions. Japanese Patent Abstracts corresponding to JP 402255898A (Oct. 16, 1990) and JP 3612802760A (Dec. 10, 1986) filed in the name of Kao Corp. describe a bacterial strain capable of producing endo-type alkaline cellulase enzymes for use in detergent compositions.

U.S. Pat. No. 5,798,327 relates to an aqueous liquid detergent composition containing a defined endoglucanase cellulase enzyme and a proteolytic enzyme. The resulting enzymatic detergent composition is said to provide in-wash stability of the cellulase enzyme.

While laundry detergent compositions containing protease, cellulase and/or lipase enzymes have been extensively described in the patent literature, there remains a need in the art for improving and enhancing the whitening and stain removal benefits capable of being provided to fabrics laundered with commercial detergent compositions containing enzymes for purposes of stain removal.

SUMMARY OF THE INVENTION

In accordance with the present invention, there is provided a laundry detergent composition which provides enhanced whitening and stain removal benefits to washed laundry comprising:

a) from about 1% to about 50%, by weight, of a surfactant or surfactant mixture selected from the group consisting of anionic and nonionic surfactants;

b) a protease enzyme in an amount sufficient to provide from at least about 0.030 to about 3.0 Kilo Novo Protease Units (KNPU) of activity of protease enzyme per gram of detergent composition;

c) a cellulase enzyme of the endoglucanase type in an amount sufficient to provide from about 0.5 to about 100 CMC units per gram of detergent composition; said detergent composition being free of an endoglucanase enzyme which is produced from Thermomonospora fusca; and d) from about 0.5% to about 10%, by weight, of an acrylic acid-based polymer or copolymer in an amount effective to provide soil suspension and/or anti-redeposition benefits in the wash bath.

In accordance with the process of the invention laundering of stained or soiled fabrics is effected by washing the fabrics to be laundered in an aqueous wash solution containing an effective amount of the above-described laundry detergent composition.

The present invention is predicated on the discovery that the combination of protease enzyme, endo-cellulase enzyme and acrylic acid-based polymer or copolymer in detergent composition in accordance with the invention provides surprisingly effective stain removal and whitening significantly better than would be expected by the levels of enzyme in the composition itself. In particular, it has been discovered that when protease enzyme is provided in a detergent composition at a level greater than about 0.06 Anson units of activity per gram of composition, the resultant combination of protease and endo-cellulase enzyme provides a synergistic whitening effect in the presence of an acrylate-based polymer such as sodium polyacrylate.

One Novo Protease Units (NPU) is the amount of enzyme which hydrolyzes casein at such a rate that the initial rate of formation of peptides/minute corresponds to 1 micromole of glycine/minute. 1 KNPU (Kilo NPU) equals 1000 NPU.

For purposes of making comparisons, 3 KNPU are approximately equal to 1 Anson unit (AU). One KNPU corresponds to about 80,000 Alkaline Delft Units or about 80 Properase Units (PU) or about 2.5 Genencor Subtilisin Units (GSU).

DETAILED DESCRIPTION OF INVENTION

The term "cellulase enzyme" as used in the present specification refers to those enzyme compositions derived from fungal sources or microorganisms genetically modified so as to incorporate and express all or part of the cellulase genes obtained from a fungal source ("fungal cellulases") or bacterial sources of cellulase. Fungi and bacteria capable of providing cellulase enzymes which are useful in detergent compositions are well documented in the literature.

Cellulases are known to be comprised of several enzyme classifications having different substrate specificity, enzymatic action patterns and the like. For example, cellulases can contain cellulase classifications which include endoglucanases and exocellobiohydrolases. For purposes of the present invention, the term "endo-cellulase" refers to those cellulase enzymes and enzyme-containing compositions which comprise at least 50% endoglucanase type components among other cellulose degrading cellulase components.

Most cellulases generally have their optimum activity in the acidic or neutral pH range although some fungal cellulases are known to possess significant activity under neutral and slightly alkaline conditions. Optimum activity of an enzyme is ordinarily a function of both pH and temperature.

The activity of endo-cellulase enzyme are generally measured using traditional biochemical activity tests based on the ability of the cellulase enzyme in question to hydrolyze soluble cellulose derivatives such as carboxymethylcellulose (CMC) thereby reducing the viscosity of CMC-containing solutions.

One carboxymethyl cellulose unit (CMCU) is the amount of enzyme which acts on carboxymethyl cellulose (CM) to form sugars at such a rate that the rate of formation of glucose/minute corresponds to 1.0 micromoles/minute. One CMCU corresponds to one International Unit (IU).

For purposes of the present invention, the amount of endo-cellulose enzyme in the laundry detergent composition is from about 0.5 to about 100 CMC units per gram of composition. Preferred activity levels range from about 1 to 25 CMC units per gram, and most preferably from about 1 to 10 CMC units per gram.

The protease enzymes used in the compositions of the invention are present at levels sufficient to provide at least about 0.030 to about 3.0 KNPU of activity per gram of composition, preferably from about 0.06 to about 0.5 KNPU per gram, and most preferably from about 0.06 to about 0.1 KNPU per gram of composition. Protease enzyme may be of animal, vegetable or microorganism origin. Suitable proteolytic include the many species known to be adapted for use in detergent compositions. Especially useful commercial enzyme preparations for the present invention include Alcalase®, Esperase® and Savinase® sold by Novo Industries, Denmark, and Maxatase®, Maxacal®, Purafect®, and Properase® sold by Genecor International.

The acrylic acid-based polymers which are useful for the compositions of the invention include the water-soluble salts of polymerized acrylic acid, such as, for example, the alkali metal, ammonium and substituted ammonium salts. Sodium polyacrylate is particularly preferred. The average molecular weight of such polymers ranges from about 2,000 to about 10,000, preferably about 4,000 to about 7,000. Use of polyacrylates of this type in detergent compositions is disclosed extensively in the patent literature such as, for example, in U.S. Pat. No. 3,308,067.

Homopolymers or copolymers of acrylic acid or methacrylic acid or hydroxyacrylic acid may be used. Sodium polyacrylate and sodium polyhydroxyacrylate are preferred homopolymers.

Acrylic/maleic-based copolymers may also be used. These copolymers include the water-soluble salts of copolymers of acrylic acid and maleic acid. The average molecular weight of such copolymers ranges from about 2,000 to about 75,000. While the average molecular weight of the polymer can vary over a wide range, it is preferably from 1,000 to about 500,000, more preferably from about 2,000 to about 250,000, and most preferably from about 3,000 to 100,000. Terpolymers based on acrylic acid may also be useful. A preferred terpolymer for purposes of the invention is an acrylic/maleic/vinyl acetate terpolymer having a molar ratio of about 45/50/5 and a molecular weight of about 4,500. Molecular weights of such terpolymer may range advantageously from about 500 to about 100,000.

Any suitable nonionic detergent compound may be used as a surfactant in the present compositions, with many members thereof being described in the various annual issues of *Detergents and Emulsifiers*, by John W. McCutcheon. Such volumes give chemical formulas and trade names for commercial nonionic detergents marketed in the United States, and substantially all of such detergents can be employed in the present compositions. However, it is highly preferred that such nonionic detergent be a condensation product of ethylene oxide and higher fatty alcohol (although instead of the higher fatty alcohol, higher fatty acids and alkyl [octyl, nonyl and isooctyl] phenols may also be employed). The higher fatty moieties, such as the alkyls, of such alcohols and resulting condensation products, will normally be linear, of 10 to 18 carbon atoms, preferably of 10 to 16 carbon atoms, more preferably of 12 to 15 carbon atoms and sometimes most preferably of 12 to 14 carbon atoms. Because such fatty alcohols are normally available commercially only as mixtures, the numbers of carbon atoms given are necessarily averages but in some instances the ranges of numbers of carbon atoms may be actual limits for the alcohols employed and for the corresponding alkyls.

The ethylene oxide (EtO) contents of the nonionic detergents will normally be in the range of 3 to 15 moles of EtO per mole of higher fatty alcohol, although as much as 20 moles of EtO may be present. Preferably such EtO content will be 3 to 10 moles and more preferably it will be 6 to 7 moles, e.g., 6.5 or 7 moles per mole of higher fatty alcohol (and per mole of nonionic detergent). As with the higher fatty alcohol, the polyethoxylate limits given are also limits on the averages of the numbers of EtO groups present in the condensation product. Examples of suitable nonionic detergents include those sold by Shell Chemical Company under the trademark Neodol®, including Neodol 25-7, Neodol 23-6.5 and Neodol 25-3.

Other useful nonionic detergent compounds include the alkylpolyglycoside and alkylpolysaccharide surfactants, which are well known and extensively described in the art.

Preferred alkyl polysaccharides for use herein are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to 18, preferably from about 12 to about 14 carbon atoms; n is 2 or 3 preferably, 2; r is from 0 to 10, preferably 0; and x is from 1.5 to 8, preferably from 1.5 to 4, most preferably from 1.6 to 2.7. To prepare these compounds, a long chain alcohol ($R_2OH$ where $R_2$ is an alkyl group of about $C_{10}$ to $C_{18}$) can be reacted with glucose, in the presence of an acid catalyst to form the desired glucoside. Alternatively, the alkyl polyglucosides can be prepared by a two step procedure in which a short chain alcohol ($R_1OH$ wherein $R_1$ is an alkyl having from 1 to 6 carbon atoms) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The term "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is Glucopon 625 CSUP glycoside manufactured by the Henkel Corporation of Ambler, Pa. Glucopon 625 CSUP is a nonionic alkyl polyglycoside characterized by the formula:

$$C_nH_{(2n+1)}O(C_6H_{10}O_5)_xH$$

wherein the alkyl chain length distribution is as follows: for n=10 (2%); n=12 (65%); n=14 (21–28%); n=16 (4–8%) and n=18 (0.5%) and x (degree of polymerization)=1.6. Glucopon 625 CSUP has a pH of 11 to 11.5 (10% of Glucopon 625 in distilled water); a specific gravity at 25° C. of 9.1 lbs./gallon; a calculated HLB of 12.1 and a Brookfield viscosity at 35° C., 21 spindle, 5–10 RPM of 3,000 to 7,000 cps.

Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulfonate, sulfate, carboxylate, phosphorate and phosphate so as to form a water-soluble detergent.

Examples of suitable anionic detergents include soaps, such as, the water-soluble salts (e.g., the sodium potassium, ammonium and alkanol-ammonium salts) of higher fatty acids or resin salts containing from about 8 to 20 carbon atoms and preferably 10 to 18 carbon atoms. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an aliphatic, preferably an alkyl radical containing from about 8 to 26, and preferably from about 12 to 22 carbon atoms. Examples of the sulfonated anionic detergents are the higher alkyl aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about ⅕ to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. A preferred polyethoxylated alcohol sulfate detergent is marketed by Shell Chemical Company as Neodol 25-3S.

The most highly preferred water-soluble anionic detergent compounds are the ammonium and substituted ammonium (such as mono, di and tri ethanolamine), alkali metal (such as, sodium and potassium) and alkaline earth metal (such as, calcium and magnesium) salts of the higher alkyl benzene sulfonates, olefine sulfonates and higher alkyl sulfates. Among the above-listed anionics, the most preferred are the sodium linear alkyl benzene sulfonates (LABS), and especially those wherein the alkyl group is a straight chain alkyl radical of 12 or 13 carbon atoms.

Amphoteric or ampholytic detergents may be used, if desired, to supplement the anionic and/or nonionic detergent in the composition of the invention. Ampholytic detergents are well known in the art and many operable detergents of this class are disclosed by A. M. Schwartz, J. W. Perry and J. Berch in "Surface Active Agents and Detergents," Interscience Publishers, N.Y., 1958, Vol. 2.

A preferred amphoteric surfactant is of the formula

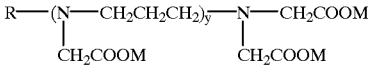

wherein R is an aliphatic hydrocarbonyl, perferably fatty alkyl or fatty alkylene, of 16 to 18 carbon atoms, M is alkali metal, and y is 3 to 4. More preferably R is tallowalkyl (which is a mixture of stearyl, palmityl and oleyl in the proportions in which they occur in tallow), M is sodium and y is about 3.5, representing a mixture of about equal parts of the amphoteric surfactant wherein y is 3 and such amphoteric surfactant wherein y is 4. Among the more preferred amphoteric surfactants of this type is that available commercially under the trade name Ampholak™ 7TX, which is obtainable from Kenobel AB, a unit of Nobel Industries, Sweden.

Builder materials may advantageously be included in the present compositions and may comprise any suitable water soluble or water insoluble builder, either inorganic or organic, providing that it is useful as a builder for the particular nonionic or anionic detergent compounds that may be employed. Such builders are well known to those of skill in the detergent art and include: alkali metal phosphates, such as alkali metal polyphosphates and pyrophosphates, including alkali metal tripolyphosphates; alkali metal silicates, including those of $Na_2O:SiO_2$ ratio in the range of 1:1.6 to 1:3.0, preferably 1:2.0 to 1:2.8, and more preferably 1:2.35 or 1:2.4; alkali metal carbonates; alkali metal bicarbonates; alkali metal sesquicarbonates (which may be considered to be a mixture of alkali metal carbonates and alkali metal bicarbonates); alkali metal borates, e.g., borox; alkali metal citrates; alkali metal gluconates; alkali metal nitrilotriacetates; zeolites, preferably hydrated zeolites, such as hydrated Zeolite A, Zeolite X and Zeolite Y; and mixtures of individual builders within one or more of such types of builders. Preferably the builders will be sodium salts and will also be inorganic. A highly preferred non-phosphate mixed water soluble and water insoluble builder composition comprises carbonate, bicarbonate and zeolite builders. Phosphate-containing builder systems will usually be based on alkali metal (sodium) tripolyphosphate and silicate builders, with such silicate being in relatively minor proportion.

Zeolite A-type aluminosilicate builder, usually hydrated, with about 15 to 25% of water of hydration is particularly advantageous for the present invention. Hydrated zeolites X and Y may be useful too, as may be naturally occurring zeolites that can act as detergent builders. Of the various zeolite A products, zeolite 4A, a type of zeolite molecule wherein the pore size is about 4 Angstroms, is often preferred. This type of zeolite is well known in the art and methods for its manufacture are described in the art such as in U.S. Pat. No. 3,114,603.

The zeolite builders are generally of the formula $$(Na_2O)_x.(Al_2O_3)_y.(SiO_2)_z.wH_2O$$

wherein x is 1, y is from 0.8 to 1.2, preferably about 1, z is from 1.5 to 3.5, preferably 2 or 3 or about 2, and w is from 0 to 9, preferably 2.5 to 6. The crystalline types of zeolite which may be employed herein include those described in "Zeolite Molecular Series" by Donald Breck, published in 1974 by John Wiley & Sons, typical commercially available zeolites being listed in Table 9.6 at pages 747–749 of the text, such Table being incorporated herein by reference.

The zeolite builder should be a univalent cation exchanging zeolite, i.e., it should be aluminosilicate of a univalent cation such as sodium, potassium, lithium (when practicable) or other alkali metal, or ammonium. A zeolite having an alkali metal cation, especially sodium, is most preferred, as is indicated in the formula shown above. The zeolites employed may be characterized as having a high exchange capacity for calcium ion, which is normally from about 200 to 400 or more milligram equivalents of calcium carbonate hardness per gram of the aluminosilicate, preferably 250 to 350 mg. eg./g., on an anhydrous zeolite basis.

Other components may be present in the detergent compositions to improve the properties and in some cases, to act as diluents or fillers. Among the suitable fillers, the most preferred is sodium sulfate. Illustrative of suitable adjuvants are enzymes supplementary to the lipase which is an integral component of the present compositions to further promote cleaning of certain hard to remove stains from laundry or hard surfaces. Among enzymes, the proteolytic and amylolytic enzymes are most useful to supplement the lipase. Other useful adjuvants are foaming agents, such as lauric myristic diethanolamide, when foam is desired, and antifoams, when desired, such as dimethyl silicone fluids. Also useful are bleaches, such as sodium perborate, which may be accompanied by suitable activator(s) to promote bleaching actions in warm or cold water. Flow promoting agents, such as hydrated synthetic calcium silicate, which is sold under the trademark Microcel® C, may be employed in relatively small proportions. Other adjuvants usually present in detergent compositions include fluorescent brighteners, such as stilbene brighteners, colorants such as dyes and pigments and perfume.

EXAMPLES

The following compositions were prepared. Composition J was a composition of the invention containing polyacrylate, cellulase, and a high level of protease. Compositions G and K contained only components of the invention, with G having polyacrylate and cellulase, but a level of protease outside the invention, and K having protease and cellulase. Example E was a control composition with conventional levels of protease and other active ingredients.

| Component (wt. %) | E | G | J | K |
|---|---|---|---|---|
| LAS[1] | 21.8 | 24.1 | 21.4 | 21.4 |
| Sodium Tripolyphosphate | 18.2 | 25.6 | 20.6 | 18.6 |
| Sodium Carbonate | 10 | 11 | 8.5 | 11 |
| Sodium Silicate | 8.9 | 8.8 | 8.8 | 8.8 |
| Optical Brightener | 0.04 | 0.04 | 0.05 | 0.05 |
| Polyacrylate[4] | — | 1.9 | 2.3 | — |
| Protease[2] | 0.42 | 0.45 | 0.87 | 0.77 |
| Endo-Cellulase[3] | — | 1.0 | 1.0 | 0.35 |
| Clay | 4.2 | 5.1 | 4.3 | 4.4 |
| Perborate | — | 2.1 | 1.9 | — |
| Na Sulfate | 31 | 11.6 | 23.6 | 28.4 |
| Moisture | 5.44 | 8.31 | 6.68 | 6.23 |
| Total | 100 | 100 | 100 | 100 |

[1]Linear alkyl benzene sulfonate anionic surfactant.
[2]The protease enzyme is Savinase 6T from Novo Nordisk Corp. The activity corresponding to 0.42 wt. % as in Composition E is 0.0252 KNPU per gram of composition.
[3]The Endo-cellulose enzyme is KAC-500 from Kao Corp. The activity corresponding to 1.0 wt % as in compositions G and J is 5 CMC units per gram of composition.
[4]Polyacrylate used was a copolymer of acrylic and maleic acids having a molecular weight of about 20,000

The compositions were evaluated monadically by over 160 panelists per formulation during a five week period. Panelists evaluated sixteen cleaning and whitening attributes versus the control composition E. Statistically significant differences were determined at a 90% confidence level. Detailed results are provided below.

The panelists indicated that composition J of the invention provided significant cleaning and whitening benefits versus the control (Example E) for 15 of 16 attributes. Compositions G and K provided little or no noticeable benefit according to the panelists. A synergy was clearly demonstrated between the two enzymes when used in amounts according to the invention in combination with polyacrylate to provide cleaning and whitening benefits with the use of composition J.

Panel Response Summary

| Type | Composition | Number of Winning Attributes vs. Control |
|---|---|---|
| Control | E | Control |
| Comparative | G (Cellulase, Polyacrylate and low level Protease) | 0 |
| Comparative | K (Protease, Cellulase) | 3 |
| Invention | J (Protease, Cellulase, Polyacrylate) | 15 |

What is claimed is:

1. A laundry detergent composition which provides enhanced whitening and stain removal benefits to washed laundry comprising:

a) from about 1% to about 50%, by weight, of a surfactant or surfactant mixture selected from the group consisting of anionic and nonionic surfactants;

b) a protease enzyme in an amount sufficient to provide from at least about 0.030 to about 3.0 Kilo Novo Protease Units (KNPU) of activity of protease enzyme per gram of detergent composition;

c) a cellulase enzyme of the endoglucanase type in an amount sufficient to provide from about 0.5 to about 100 CMC units per gram of detergent composition; said detergent composition being free of an endoglucanase enzyme which is produced from Thermomonospora fusca; and d) from about 0.5% to about 10% by weight, of an acrylic acid-based polymer, copolymer or terpolymer in an amount effective to provide soil suspension and/or anti-redeposition benefits in the wash bath.

2. A laundry detergent composition according to claim 1 wherein the amount of said surfactant mixture is from about 10% to about 30% by weight.

3. A laundry detergent composition according to claim 1 wherein the amount of protease enzyme provides from about 0.06 to about 0.5 KNPU per gram of composition.

4. A laundry detergent composition according to claim 3 wherein the amount of protease enzyme provides from about 0.06 to about 0.1 KNPU per gram of composition.

5. A laundry detergent composition according to claim 1 wherein the amount of cellulase enzyme provides from about 1 to 25 CMC units per gram of composition.

6. A laundry detergent composition according to claim 1 wherein the amount of cellulase enzyme provides from about 1 to 10 CMC units per gram of composition.

7. A laundry detergent composition according to claim 1 wherein the amount of acrylic acid-based polymer, copolymer or terpolymer is from about 1% to about 5% by weight.

8. A laundry detergent composition according to claim 1 which further contains an effective amount of a perborate bleach for stain removal in the absence of a bleach activator.

9. A laundry detergent composition according to claim 8 wherein the perborate bleach is sodium perborate.

10. A method of cleaning soiled fabrics comprising the step of contacting such spoiled fabrics with an aqueous solution containing an effective amount of the composition of claim 1.

* * * * *